United States Patent [19]

Delgado et al.

[11] 4,300,525

[45] Nov. 17, 1981

[54] SAFE KNOB

[76] Inventors: Jesus Delgado; George Spector, both c/o George Spector, 3615 Woolworth Bldg., 233 Broadway, New York, N.Y. 10007

[21] Appl. No.: 48,750

[22] Filed: Jun. 15, 1979

[51] Int. Cl.[3] ..... F24C 3/12

[52] U.S. Cl. ..... 126/42; 137/384.2

[58] Field of Search ..... 126/42, 39 E; 137/385, 137/384.2; 70/175, 179

[56] References Cited

U.S. PATENT DOCUMENTS 1,633,233 6/1927 Smith ..... 126/42

1,787,401 12/1930 Spangler ..... 137/385

2,161,070 6/1939 McDonough ..... 126/42

2,250,356 7/1941 Brumbaugh ..... 126/42

*Primary Examiner*—Ronald C. Capossela

[57] ABSTRACT

A control knob for turning on or off a burner of a kitchen gas stove, the knob including a cam-faced spur on a side of the knob shank which travels behind a stationary stop mounted on the stove when the knob is being turned to shut off the gas, the stop preventing the knob to be turned on again unless the knob is first pushed axially so the spur clears the stop, the construction preventing children to readily turn the gas on.

4 Claims, 7 Drawing Figures

SAFE KNOB

This invention relates generally to safety controls for gas stoves or other appliances.

It is well known that many unattended children are either seriously burned or fatally suffocated by turning on a kitchen gas stove when playing with the stove burner control knobs. This terrible situation is in serious want of immediate improvement.

Accordingly, it is a principal object of the present invention to provide a new design of gas stove burner control knob which is not readily easy to be turned on by small children, because it first requires an axial push thereof against a force of a return spring so to get into a position from which only it is possible to be rotated in order to turn on a gas.

Another object is to provide a safe knob which additionally is automatically wedged into a fully closed position when turned off, thereby preventing an gas leakage such as occurs when a knob is carelessly not turned into fully closed position.

Figure 1:
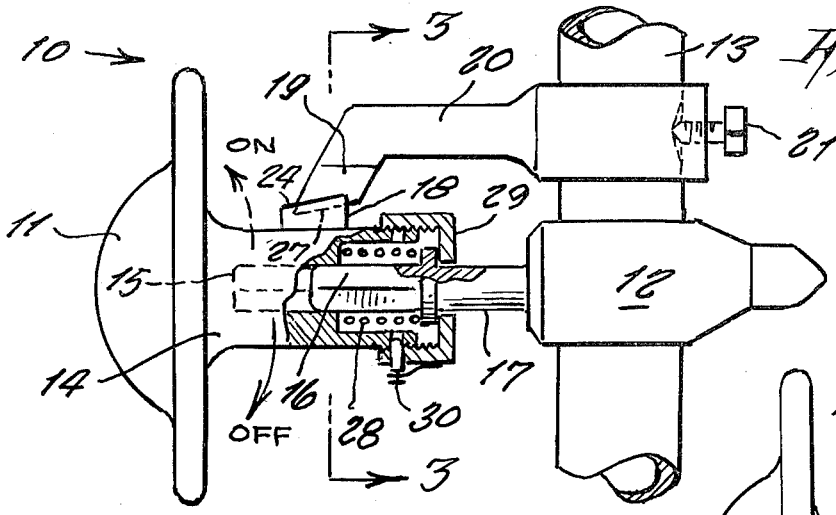
FIG. 1 is a top view of the invention shown partly in cross section, and showing the knob in a locked, closed position.
Figure 2:
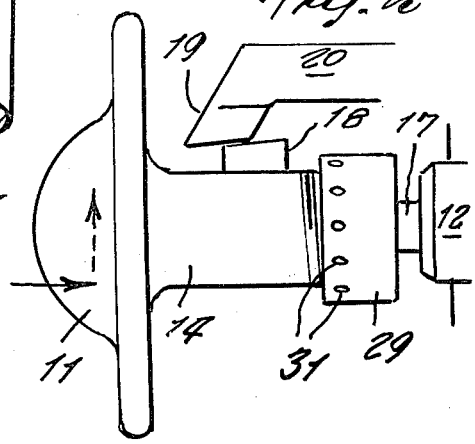
FIG. 2 is a side view showing how the knob is unlocked by being pushed inward so to clear the stop that prevents the knob rotation.
Figure 3:
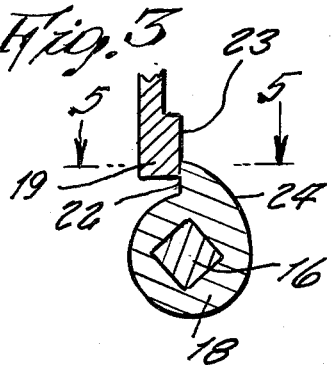
FIG. 3 is a cross sectional view on line 3–3 of FIG. 1, showing the knob cam locked against the stop.
Figure 4:
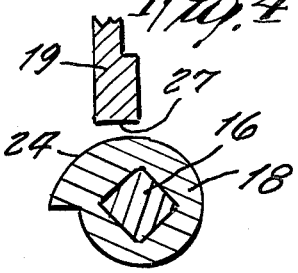
FIG. 4 is a similar view showing the knob in a rotated on position so is free to raise or lower a gas flame, as wished.

Referring now to the drawing in greater detail, and more particularly to FIGS. 1 through 6 thereof at this time, the reference numeral 10 represents a safe knob assembly according to the present invention wherein there is a burner control knob 11 that serves to open or shut a valve 12 along a gas line 13 that leads to the stove burner. The knob includes a shank 14 integral therewith having a square central opening 15 into which a square end 16 of a valve stem 17 extends for transmitting rotational movement from the knob to the valve.

In the present invention, a cam-faced spur 18 is formed on a side of the shank 14 for getting locked behind a stationary stop 19 when the knob is turned to "off" position, so to prevent the knob being thereafter turned directly into "on" position again.

The stop is at an end of an arm 20 securely locked in position around the gas line 13 by means of a set screw 21.

In the closed position a face 22 of the spur rests against a face 23 of the stop, thus locking the knob against rotation into "on" position. However, when the knob is being rotated from the "on" to the "off" position, the spur is allowed to get behind the stop, by means of the knob being axially shifted upon the square end of the valve stem, so that the spur gets around a side end of the stop. This is done automatically without need of a person to manually push the knob in order to do so, and is accomplished by an inclined cam face 24 of the spur striking against an edge 25 of the stop, thereby causing the knob to be automatically shifted axially into a direction indicated by arrow 26, so that the inclined cam face of the spur thus passes under a corresponding inclined lower end face 27 of the stop. After the spur thus passes the stop, a compression coil spring 28 inside the shank shifts the knob axially back to its original position, (the spring having been compressed while the spur passed around the stop).

Figure 5:
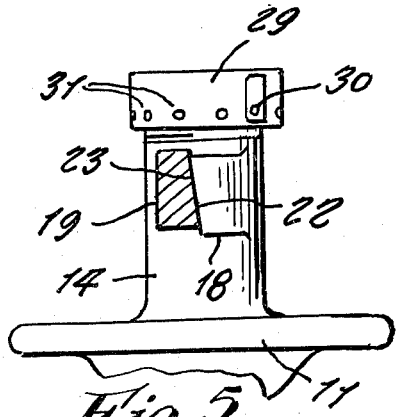
FIG. 5 is a cross sectional view on line 5—5 of FIG. 3, showing how the stop locks the knob without any free play of the knob, and which is due to the spring in the knob pushing the knob axially against the stop.
Figure 6:
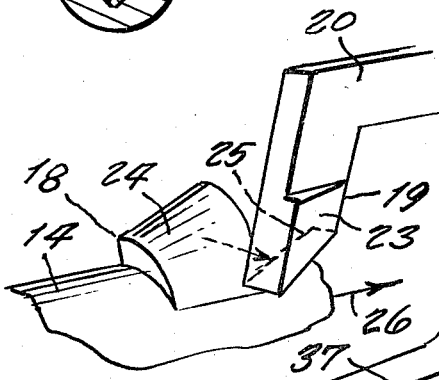
FIG. 6 is a detail showing how the knob cam automatically causes the knob to slide axially so to clear the stop when the knob is being turned into a shut off position.

As clearly shown in FIG. 5, the faces 22 and 23 are inclined respective to the longitudinal axis of the shank and valve stem, so that when the spring shifts the knob back to original position, the knob is then wedged against the stop, thereby eliminating any free play in the knob rotation, so to prevent any small gas leakage, by the knob being tightly closed.

When an adult wishes to turn on the gas burner, he then must first manually push the knob sufficiently so the spur clears the stop, after which he can then rotate the knob.

In the present invention, the compression force of the spring is adjustable so to resist against growing children gaining more power, as wished. This is accomplished by an end cap 29 being threaded further upon the shank so to further compress the spring. A detent 30 selectively engaged in one of the openings 31 locks the selected adjustment.

Figure 7:
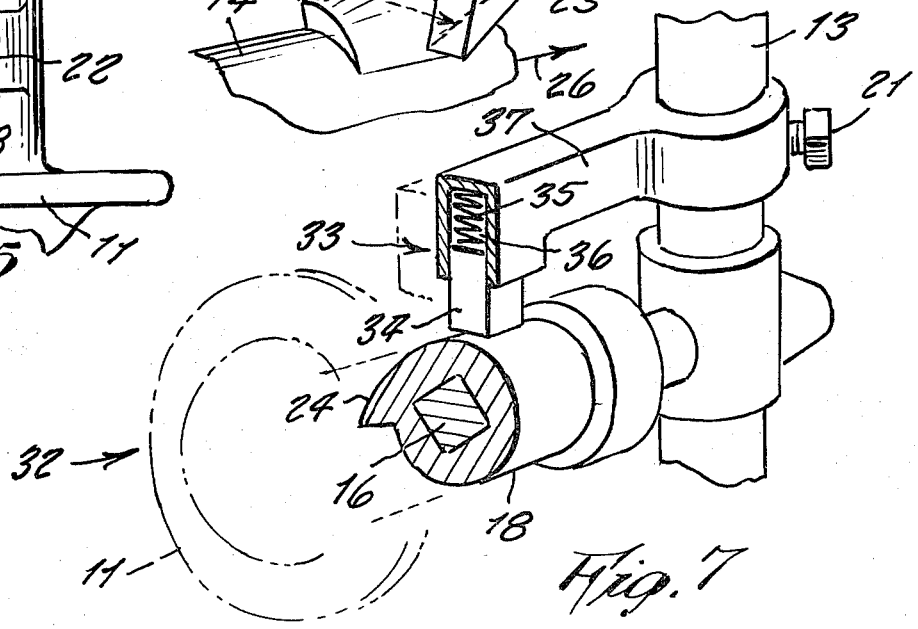
FIG. 7 shows another design of the invention in which the stop comprises a simple spring biased block.

In FIG. 7, another design of safe knob 32 includes the above described knob assembly, but the stop 33 differs by simply comprising a block 34 slidable against a compression spring 35 in a recess 36 formed on the stop arm 37. This construction eliminates the incline of the cam face 24 and lower side 27.

What is claimed:

1. A safe knob assembly for a kitchen gas stove burner, comprising in combination, a knob integral with shank having a square central opening slidably fitted on a square end of a stem of a gas valve along a gas line of a stove, a cam-faced spur on a side of said shank, and a stationary stop mounted separately adjacent said spur in combination with means for axially moving said shank in response to rotation in one direction of said shank and wherein rotation in opposite direction is restricted by engagement of said spur and stop.

2. The combination as set forth in claim 1, wherein said means comprise a cam face and a coacting end face of said stop said faces being angularly inclined respective to the longitudinal axis of said shank and valve stem, said means further comprising a spring between said shank and valve stem.

3. The combination of claim 2 wherein said spring is mounted between said shank and a transverse flange on said stem.

4. The combination of claim 3 including means for varying compression of said spring by a constant increment.

* * * * *